US005664625A

United States Patent [19]

Letrange et al.

[11] Patent Number: 5,664,625

[45] Date of Patent: Sep. 9, 1997

[54] HEADER PLATES FOR HEAT EXCHANGERS

[75] Inventors: Frederic Letrange, Nanterre; Carlos Martins, Montfort l'Amaury, both of France

[73] Assignee: Valeo Thermique Moteur, Le Mesnil-Saint-Denis, France

[21] Appl. No.: 764,457

[22] Filed: Dec. 12, 1996

[30] Foreign Application Priority Data

Dec. 13, 1995 [FR] France ..... 95 14785

[51] Int. Cl.[6] ..... F28F 9/02

[52] U.S. Cl. ..... 165/173; 165/149; 165/DIG. 471; 165/DIG. 474

[58] Field of Search ..... 165/149, 153, 165/173

[56] References Cited

U.S. PATENT DOCUMENTS

| | | | |
|---|---|---|---|
| 4,582,127 | 4/1986 | Moranne . | |
| 4,917,182 | 4/1990 | Beamer | 165/173 |

FOREIGN PATENT DOCUMENTS

| | | | |
|---|---|---|---|
| 406774 | 1/1911 | European Pat. Off. | 165/173 |
| 581684 | 2/1994 | European Pat. Off. | 165/173 |
| 651 221 | 5/1996 | European Pat. Off. . | |
| 2 538 526 | 6/1984 | France . | |
| 2816291 | 10/1979 | Germany | 165/173 |
| 6-185889 | 7/1994 | Japan | 165/149 |
| 914539 | 1/1963 | United Kingdom | 165/149 |

*Primary Examiner*—Allen J. Flanigan
*Attorney, Agent, or Firm*—Morgan & Finnegan, LLP

[57] ABSTRACT

A heat exchanger for a heating or cooling circuit of a motor vehicle comprises a header plate with a header cover sealingly secured over it, and a number of tubes extending through the header plate. The outer flanks of the collar portions of the header plate, which surround the ends of the tubes situated at the ends of the row of tubes are joined directly, along an inclined plane, to the peripheral channel in which the peripheral edge portion of the header cover is received. The overall length of the header plate, and therefore that of the heat exchanger as a whole, is thereby reduced.

8 Claims, 2 Drawing Sheets

HEADER PLATES FOR HEAT EXCHANGERS

FIELD OF THE INVENTION

This invention relates to header plates for heat exchangers, and in particular, though not exclusively, to heat exchangers for use in heating and/or cooling systems for motor vehicles.

More particularly, the invention relates to a header plate for sealed assembly, firstly to a header cover in the form of a hollow vessel, thereby defining with the header cover at least one chamber for containing a heat exchange fluid, and secondly to a multiplicity of tubes for the flow of the said fluid, the said tubes being in communication with the said chamber or chambers, wherein the header plate comprises: a central plate element which extends substantially in a plane; a peripheral region defining an annular channel for receiving the peripheral edge portion of the header cover and, if required, a sealing gasket; and a multiplicity of inclined annular collar portions, each of which surrounds a through aperture for containing a respective one of the said tubes, each said aperture being formed in the interior of the plate element, with the peripheral region and the collar portions extending from the said plane on one side and on the other side of the said plane, respectively.

BACKGROUND OF THE INVENTION

In known header plates, the peripheral region is joined to a marginal portion of the plate element which extends entirely around all of the collar portions.

DISCUSSION OF THE INVENTION

The object of the invention is to reduce the overall size of the header plate by comparison with the above mentioned known form of header plate.

According to the invention in a first aspect, a header plate for sealed assembly, firstly to a header cover in the form of a hollow vessel, thereby defining at least one chamber for containing a heat exchange fluid, and secondly to a multiplicity of tubes for the flow of the said fluid, the said tubes being in communication with the said chamber or chambers, wherein the header plate comprises: a central plate element which extends substantially in a plane; a peripheral region defining an annular channel for receiving the peripheral edge portion of the header cover and, if required, a sealing gasket; and a multiplicity of inclined annular collar portions, each of which surrounds a through aperture for containing a respective one of the said tubes, each said aperture being formed in the interior of the plate element, with the peripheral region and the collar portions extending from the said plane on one side and on the other side of the said plane, respectively, is characterised in that, in some zones along the length of the annular channel, the profile of the inner side wall of the channel is joined directly to the profile of an adjacent said collar portion without passing through the direction of the said plane.

The said profiles, joined together, are preferably situated substantially on a common straight line.

Preferably, the collar portions are aligned in a row, with each said collar portion being elongated at right angles to the direction of this alignment.

Preferably, the said profiles are joined directly to each other in the region of the two ends of each collar portion.

Preferably, each collar portion has two substantially flat longitudinal sides, and the profile of the flat outer side of each of the endmost collar portions in the row is joined directly to the profile of the wall, also flat, of the channel over the whole length of the said side of that collar portion.

The said profile of the flat outer side of each of the endmost collar portions is preferably inclined more steeply with respect to the general plane of the plate element than are the other sides of the collar portions.

Preferably, the flat outer side of each of the endmost collar portions has substantially the same inclination with respect to the general plane of the plate element than the other sides of the collar portions, and defines an obtuse dihedral with the wall of the channel.

According to the invention in a second aspect, a heat exchanger, especially for a heating and/or cooling circuit in a motor vehicle, comprises a header plate according to the first aspect of the invention, assembled in a sealed manner with, firstly, a header cover in the form of a hollow vessel, thereby defining with the header cover at least one chamber for containing a heat exchanger fluid, and secondly, to a multiplicity of tubes for the flow of the said fluid, the said tubes being in communication with the said chamber or chambers, the said channel receiving the peripheral edge portion of the header cover and, if required, a sealing gasket, and the said tubes extending through the said apertures in the header plate and being tightly surrounded by the said collar portions.

The various features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
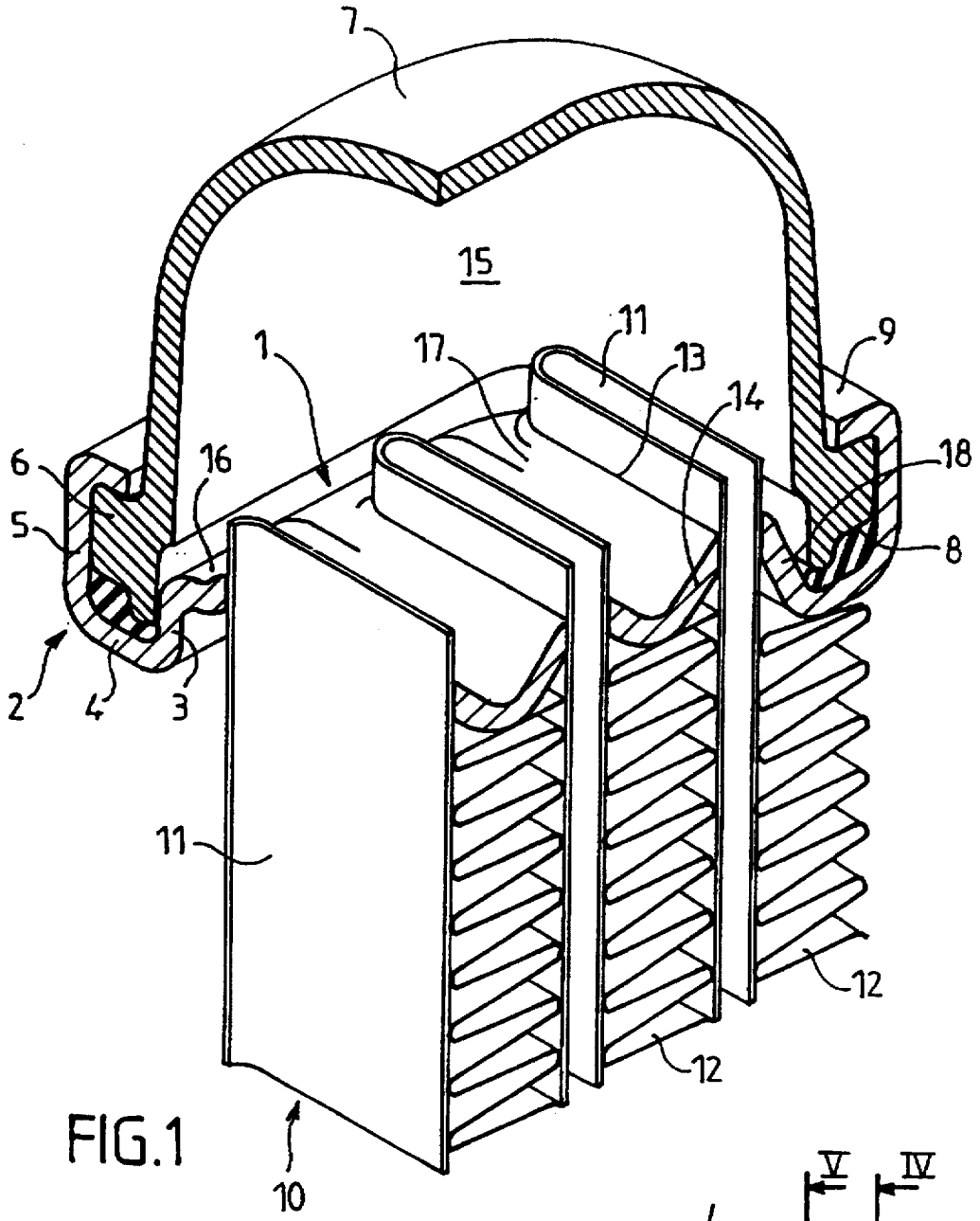
FIG. 1 is a perspective view showing, partly cut away, a header plate in accordance with the invention associated with a header cover and a bundle of tubes.
Figure 2:
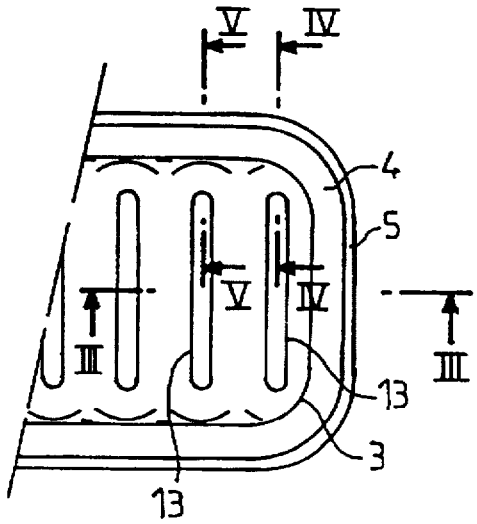
FIG. 2 is a top plan view of the header plate shown in FIG. 1.

The header plate 1 shown in the drawings is press-formed from metal plate. It includes a peripheral region 2 which defines an annular channel having an inner side wall 3, a base portion 4 and an outer side wall 5. A header cover 7, in the form of a hollow vessel, has a peripheral edge portion 6 which is fitted, together with a sealing gasket 8, into this channel of the header plate. After assembly, the free edge 9 of the outer wall 5 is upset in a seaming operation on to the edge portion 6 of the header cover 7, so as to secure the latter in position on the header plate, at the same time compressing the gasket 8 between the edge portion 6 and the base portion 4 of the channel. The header plate is shown in FIGS. 2 to 5 before this seaming operation is carried out.

The heat exchanger which is partly shown in FIG. 1 also includes a tube bundle 10 which consists of a row of tubes 11, each of which has an oblong transverse cross section which is elongated in the direction of the width of the header plate 1. The tubes 11 are spaced apart from each other over the greater part of their length, by means of spacing inserts 12 in the form of corrugated strips. Each tube 11 extends through an aperture 13 of corresponding profile. The apertures 13 are formed in the central region of the header plate 1. Each of these apertures 13 is surrounded by an inclined collar portion 14. Thus, the end of each tube is open into the internal space 15, or header chamber, of the header which consists of the header cover 7 and the header plate 1. The inserts 12 are located outside this internal space.

In the manner known per se, along each of the two major sides of the peripheral channel 3 to 5, which has a generally rectangular contour, the inner wall 3 of the latter is joined to the ends of the collar portions 14 through an interposed flange portion 16 which is orientated substantially at right angles to the longitudinal direction of the tubes 11. The two flange portions 16, with the bottoms of valleys 17 which lie between the collar portions 14, constitute a plate element of the header plate 1. This plate element defines, and extends substantially in, a plane at right angles to the above mentioned direction. In practice, however, the plate element is not entirely flat, since the flange portions 16 have a slightly corrugated form so as to place a limit on the mechanical stresses which occur during manufacture of the header plate 1.

This plate element does in fact not include any flange portion along the minor sides of the peripheral channel (see FIG. 3), in which the inner wall 3 of the channel is joined directly to the external flank of the endmost collar portion in the row, thus constituting a single inclined plane 18. This arrangement reduces the overall size of the heat exchanger in the longitudinal direction of the header plate 1 by twice the width of the flange portion 16. In addition, the inclined plane 18 is inclined by a greater amount with respect to the general plane of the above mentioned plate element than are the other flanks of the various collar portions 14, and this has the effect of reducing the above mentioned overall size even more. Having regard to the radius of the rounded portions defined by the channel 3 to 5 in the angles of the header plate, the endmost collar portions 14 in the row are joined directly to the inner wall 3 of the channel, and also at their ends, by inclined surfaces 19. In this way, it is only the intermediate collar portions, i.e. not the two endmost ones, that are separated from the peripheral channel by the flange portions 16.

Figure 3:
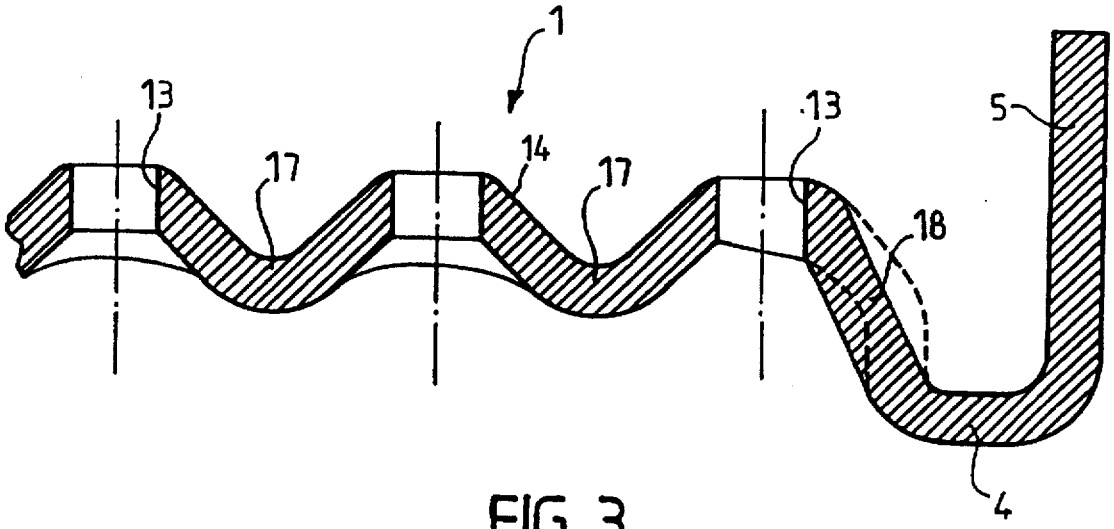
FIG. 3 is a scrap view in cross section taken on the line III—III in FIG. 2.
Figure 4:
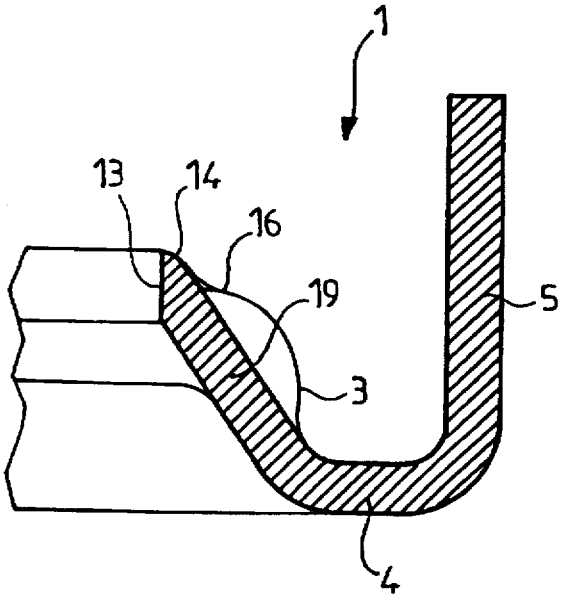
FIG. 4 is a scrap view in cross section taken on the line IV—IV in FIG. 2.
Figure 5:
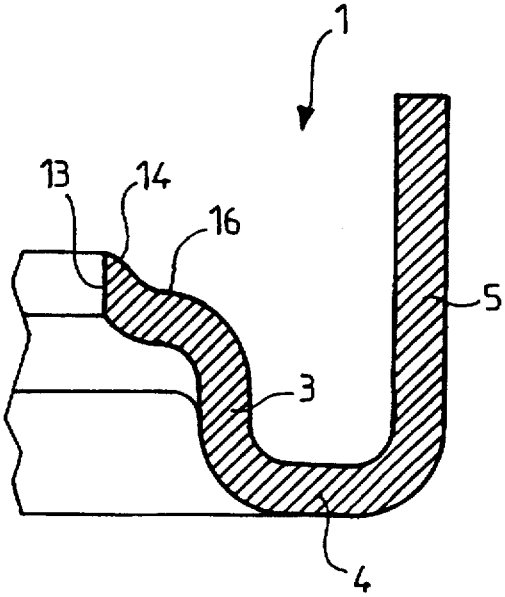
FIG. 5 is a scrap view in cross section taken on the line V—V in FIG. 2.

In a modified version, which is indicated in broken lines in FIG. 3, the inclined plane 18 may have substantially the same inclination with respect to the general plane of the plate element 16, 17 than the other flanks of the collar portions, thus defining an obtuse dihedral with the inner wall 3 of the channel, the latter then being at right angles to the general plane of the plate element.

In another version, the collar portions are joined directly to the walls of the channel, not over the whole width of the header plate 1 but over its whole length, thus reducing the overall size of the heat exchanger in the direction of its width.

What is claimed is:

1. A header plate for a heat exchanger comprising said header plate, a header cover sealingly secured on the header plate to define a header space between them, and a bundle of tubes extending through the header plate and open into the header space, the header cover having a peripheral edge portion, the header plate comprising: a central plate element defining a plane and extending substantially in the said plane; a peripheral region defining an annular channel receiving the said peripheral edge portion of the header cover; and a plurality of inclined annular collar portions, each defining a through aperture bounded by the collar portion, for the fitting of a respective said tube in each said aperture, the peripheral region extending from the said plane on one side of the said plane, and the collar portions extending from the said plane on the other side of the said plane, wherein the said channel has an inner side wall having a profile which, in some zones of the length of the channel, is joined directly to the profile of an adjacent said collar portion without passing through the direction of the said plane.

2. A header plate according to claim 1, wherein the said profiles joined directly together lie substantially on a common straight line.

3. A header plate according to claim 1, wherein the collar portions are aligned in a row, each collar portion being elongated at right angles to the direction of alignment of the collar portions.

4. A header plate according to claim 3, wherein the said profiles joined directly together are in the region of the two ends of each collar portion.

5. A header plate according to claim 3, wherein each collar portion has two substantially flat longitudinal sides, each of the endmost collar portions in the row having a flat outer side with a profile which is joined directly to the profile of the inner side wall of the channel over the whole length of the said side of that collar portion, the inner side wall of the channel being flat.

6. A header plate according to claim 5, in which the said profiles joined together are situated substantially on a common straight line, and wherein the said profile of the flat outer side of each of the endmost collar portions is inclined more steeply with respect to the said plane than are the other sides of the plurality of collar portions.

7. A header plate according to claim 5, wherein the flat outer side of each of the endmost collar portions defines substantially the same inclination with respect to the said plane as the other sides of the plurality of collar portions, and defines an obtuse dihedral with the inner side wall of the channel.

8. A heat exchanger comprising a header plate according to claim 1, a header cover in the form of a hollow vessel sealingly assembled to the header plate so as to define therewith at least one header chamber for containing a heat exchange fluid, a multiplicity of tubes for flow of the said fluid therein, said tubes being in communication with the header chamber, or variously with each header chamber, the tubes being sealingly assembled to the header plate, the header cover having a peripheral edge portion received in the said channel of the header plate, and each said tube extending through a said aperture in the header plate with a corresponding said collar portion tightly surrounding the tube.

* * * * *